United States Patent [19]

Kervizic et al.

[11] 4,004,181

[45] Jan. 18, 1977

[54] HYPERFREQUENCY RESONANT SYSTEM FOR ACCELERATING A CHARGED PARTICLE BEAM AND A MICROTON EQUIPPED WITH SUCH A SYSTEM

[75] Inventors: Jacques Kervizic; Duc Tien Tran, both of Paris, France

[73] Assignee: C.G.R.-Mev., Paris, France

[22] Filed: May 6, 1975

[21] Appl. No.: 574,944

[30] Foreign Application Priority Data

May 10, 1974 France ..... 74.16201

[52] U.S. Cl. ..... 315/5.41; 315/5.42; 315/5.43

[51] Int. Cl.² ..... H01J 25/10

[58] Field of Search ..... 315/5.41, 5.42, 5.43

[56] References Cited

UNITED STATES PATENTS

| | | | |
|---|---|---|---|
| 3,068,425 | 12/1962 | Boutet et al. | 315/5.43 |
| 3,354,348 | 11/1967 | Van Iperen | 315/5.43 |
| 3,403,346 | 9/1968 | Giordano | 315/5.42 X |
| 3,546,524 | 12/1970 | Stark | 315/5.41 |
| 3,811,065 | 5/1974 | Lien | 315/5.43 |

*Primary Examiner*—Saxfield Chatmon, Jr.
*Attorney, Agent, or Firm*—Cushman, Darby & Cushman

[57] ABSTRACT

The present invention relates to an hyperfrequency resonant system designed to accelerate a beam of charged particles, and comprising at least a first resonant cavity (or a group of resonant cavities similar to this first cavity) tuned at a fundamental frequency F and excited by means of an external electro-magnetic energy source and a resonant element which is, for example, a second resonant cavity tuned at harmonic frequency 2F and excited by means of the bunched particle beams. The invention is applicable, for example, to particle accelerators of the "microtron" kind.

5 Claims, 6 Drawing Figures

HYPERFREQUENCY RESONANT SYSTEM FOR ACCELERATING A CHARGED PARTICLE BEAM AND A MICROTON EQUIPPED WITH SUCH A SYSTEM

The present invention relates to a resonant hyperfrequency system designed more especially for an accelerator of "microtron" type.

A conventional microtron essentially comprises an accelerating cavity through which there passes several times an electron beam whose electrons can be accelerated by the action of an electromagnetic field generated in this cavity. The electrons then describe a circular trajectory whose radius increases with each transit through the accelerating cavity.

One of the chief factors to limit the performance of this kind of microtron, is the fact that the phase acceptance zone is often too narrow; this zone is that in which all the particles arriving in the resonator are accelerated. In other words, it should be as wide as possible because electrons outside this zone remain in the accelerator cavity and consume the microwave energy unnecessarily.

To increase the dimensions of the acceptance zone it is known to utilise two cavities resonating at two different frequencies, one at the fundamental frequency F and the other at a harmonic. Excitation of these cavities is effected by means of a first electromagnetic energy source furnishing the fundamental frequency and a second electromagnetic energy source which could be a multiplier stage associated with the first and furnishing the desired harmonic frequency.

This invention relates to an hyperfrequency accelerating resonant system which can be excited at a fundamental frequency F and a harmonic frequency 2F without it being necessary to have recourse to two sources of electromagnetic energy or to a frequency multiplier.

The invention relates more especially to an hyperfrequency resonant system designed to accelerate a beam of charged particles emitted by a particle source, said resonant system comprising at least a first resonant cavity tuned at a fundamental frequency F and excited at said frequency F by means of an external electromagnetic energy source, said first resonant cavity being associated with a resonant element tuned to the harmonic frequency 2F, said resonant element being excited at said frequency 2F by said beam of charged particles.

For a better understanding of the invention and to show how the same may be carried unto effect, reference will be made to the drawings, given solely by way of example, which accompany the following description, and wherein.

To simplify understanding of the description, similar elements have been given the same references in all the figures.

Figure 1:
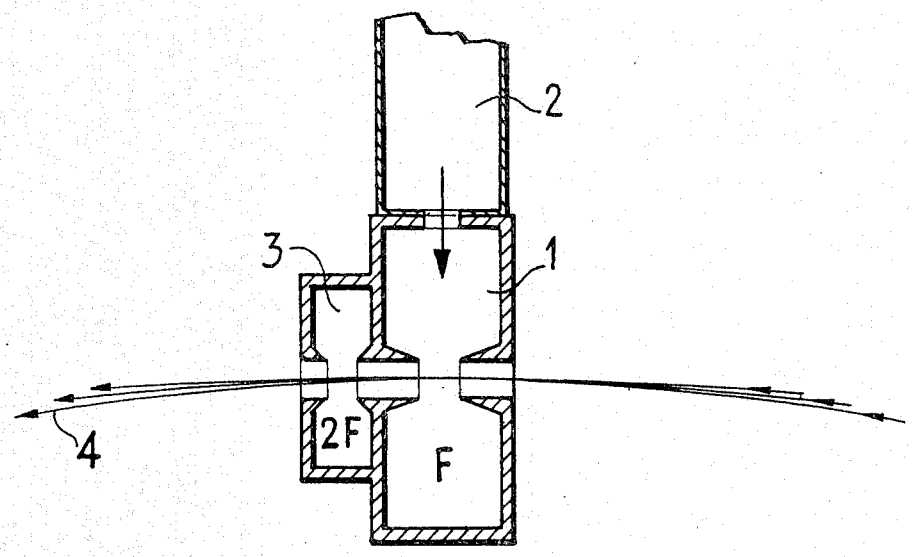
FIG. 1 is a schematic illustration of an embodiment of a device in accordance with the invention.

FIG. 1 schematically illustrates an accelerating resonant system in accordance with the invention, forming part of a microtron used for accelerating an electron beam 4 and whose other parts have not been shown. The system essentially comprises a first resonant cavity 1 excited at the fundamental frequency F by means of an electromagnetic energy source through the medium of a coupling system 2 which may for example be a waveguide or a coaxial line. A second resonant cavity 3 is coupled to the first cavity 1 and is designed to resonate at a frequency 2F twice the fundamental frequency F. This second cavity 3 is excited, in accordance with the invention, by the electron beam 4 itself, this beam 4, passing through the first and second cavities, being rich in harmonics. The electron beam 4, some of the orbits of which have been shown in FIG. 1, is produced by an electron gun correctly positioned in relation to the cavity and not shown in the figure because the arrangement is an entirely conventional one. The electron beam 4 which is rich in harmonics, especially the second harmonic, can advantageously excite the cavity 3 which is turned to the second harmonic frequency 2F. In order for the desired effect to be achieved, there must exist between the signals a phase and amplitude condition which will be dealt with later on in the description.

Figure 2:
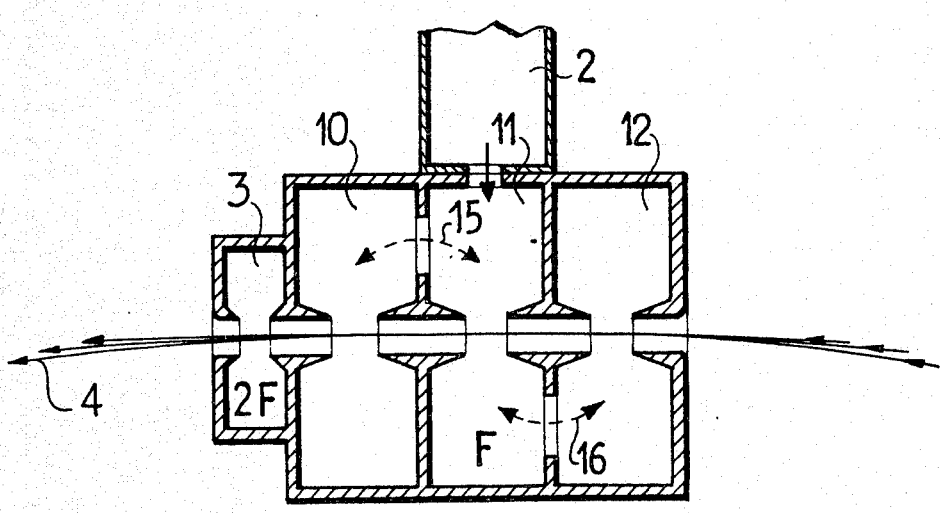
FIG. 2 is a variant embodiment of the previous figure.

FIG. 2 is a schematic illustration of a variant embodiment of the FIG. 1. In this case, the resonant system in accordance with the invention is constituted by a group of cavities 10, 11 and 12, for example, similar to the first cavity 1 and coupled together in the manner shown by the arrows 15 and 16 and tuned to the fundamental mode F. The electromagnetic energy is furnished, as in the variant embodiment described earlier, by the electromagnetic energy source associated with the coupling system 2. The resonant cavity 3, mechanically coupled to the resonant cavity 10 is tuned, at the harmonic frequency 2F by mean of the electron beam 4 passing through the resonant system. The essential feature of the invention resides in the fact that the energy at the frequency 2F is picked off from the electron beam without any necessity to have recourse to a second, independent energy source.

Figure 3:
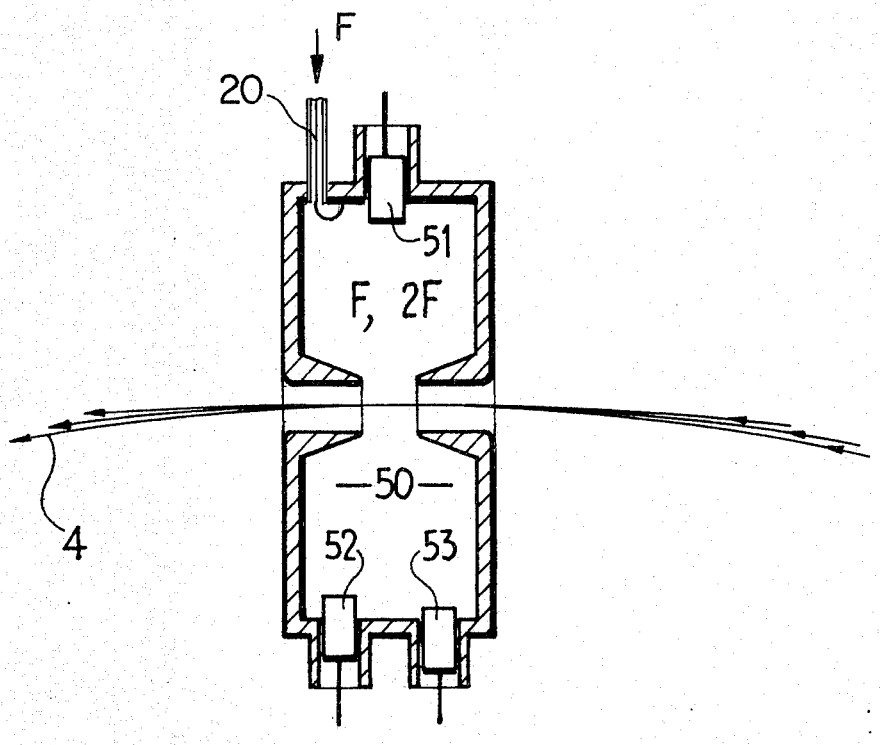
FIG. 3 is a schematic illustration of a second embodiment of the invention.

FIG. 3 is an another embodiment of a resonant system in accordance with the invention. This resonant system comprises a single resonant cavity 50 provided with tuning pistons 51, 52 and 53. This resonant cavity 50 is designed to resonate, as already referred to earlier, at a frequency F and a frequency 2F. To meet this condition, it is merely necessary to use a cylindrical cavity having a length equal to half the wavelength. If, to reduce the transit time of the electrons, a flatter cavity has to be used, then the addition of noses which are visible in all the figures, still enables this condition to be satisfied. The adjustment of the frequency can for example be achieved by using the set of tuning pistons such as those 51, 52 and 53. The piston 51 is radially arranged at half-length of the cylindrical cavity 50. Under these conditions, it has virtually no effect upon the harmonic frequency 2F since the magnetic field there is zero for this mode. In contrast, the tuning pistons 52 and 53 act upon the fundamental frequency F and the harmonic frequency 2F at the same time. Thus, by adjusting the respective positions of the three pistons 51, 52 and 53, it is possible to achieve the conditions of frequency and phase between the two signals, which are specified at a later time in this description. As in the case of the other examples described earlier, the essential characteristic of the invention here again resides in the origin of the harmonic frequency energy which is picked off from the electron beam itself.

Figure 4:
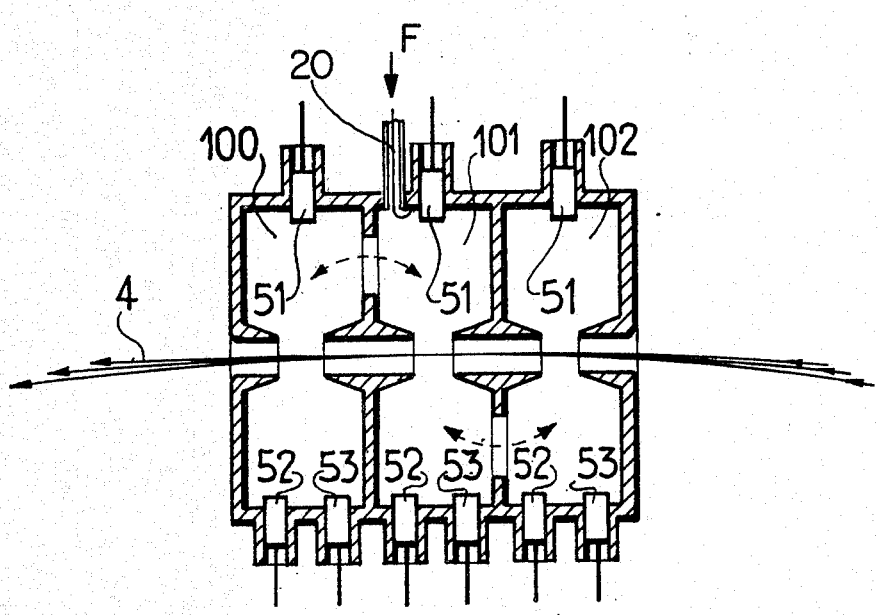
FIG. 4 is a variant embodiment of FIG. 3.

Finally, as FIG. 4 shows, the device may comprise a group of cavities similar to the first cavity 50 tuned at the frequency F and excited by a suitable source 20. Each of these cavities 100, 101, 102 are provided with tuning piston 51, 52, 53 positioned within these cavities 100, 101, 102 as above described and shown in FIG. 3.

Whatever the situation, therefore, the system in accordance with the invention comprises a first cavity 1 (or several cavities similar to this first cavity) tuned to and excited at the fundamental frequency F and a least one resonant element tuned to the harmonic frequency 2F and excited by the bunched beam. This resonant element will either be a supplementary cavity 3 or the cavity 50, provided with a set of tuning pistons as described earlier, enabling this cavity 50 so arranged to resonate at the two frequencies F and 2F simultaneously.

As calculation shows and experience confirms, the utilization of two high-frequency sources having respectively frequencies F and 2F, makes it possible to achieve an appreciable gain in the accelerator field. In other words, when two frequencies are involved, one being the fundamental and the other the harmonic 2F, the expression for the accelerator field is as follows:

$$E = Eo\ [\cos 2\pi F\ t + a \cos (4\pi Ft + \phi)]$$

where $a$ and $\phi$ are respectively the amplitude and phase of the harmonic 2F relatively to the fundamental frequency.

Figure 5:
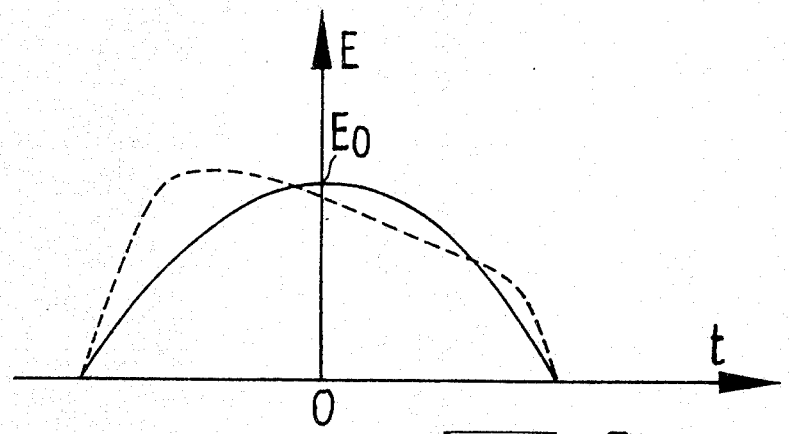
FIGS. 5 and 6 are explanatory diagrams illustrating the advantages of the present invention.
Figure 6:
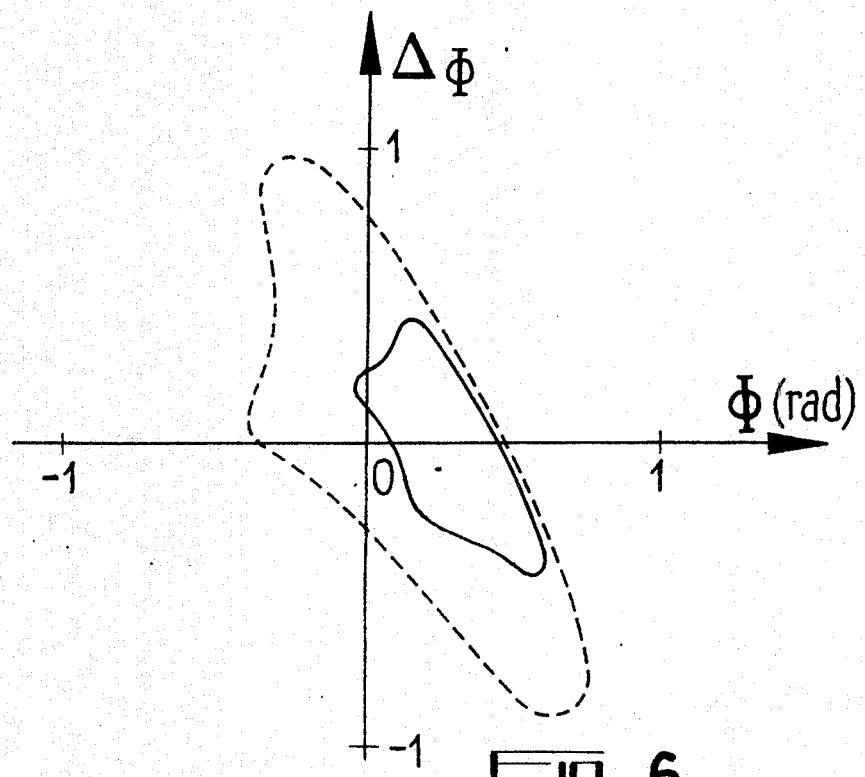

If, for example, we take $a = -0.2$ and $\phi = -\pi/4$, the graphs of FIG. 5 show the time-based development of the accelerator field without the harmonic 2F (full-line curve) and with the harmonic 2F (broken line curve). The graphs of FIG. 6 show the corresponding stability zones in the phase space $(\Delta\phi,\phi)$ where $\Delta\phi$ represents the phase interval between two successive revolutions and $\phi$ represents the phase of the electron in relation to the wave peak. $\Delta\phi$, to within a factor of $2\pi$, represents the energy dispersion. A consideration of these graphs shows that due to the presence of the second harmonic, the phase acceptance shifts from 0.4 radians to 0.8 radians. There is therefore a doubling in the effective current picked up. To achieve this phase and amplitude relationship between the two aforesaid signals, it is sufficient by way of example to suitably detune the resonance frequency of the cavity designed to furnish the second harmonic energy picked off from the beam.

The device in accordance with the invention makes it possible to substantially improve the current pick-off factor of the microtron to which it is fitted, whilst substantially increasing the phase acceptance of the equipment.

What we claim is:

1. A hyperfrequency resonant system for producing a charged electron beam in a microtron accelerator, said particle beam having substantially circular paths whose radii increase with each transit of said beam through said resonant system, said resonant system which is disposed along said beam comprising at least a plurality of first resonant cavities fixed with respect to each other tuned at a fundamental frequency F and excited at said frequency F by means of an external electromagnetic energy source, said first resonant cavity being disposed along the beam axis associated with a resonant element tuned to the harmonic frequency 2F and disposed along said beam axis and fixed with respect to said first cavities, said resonant element being excited at frequency 2F by means of said beam, the particles of which are bunched after the first passage of said beam through said resonant system.

2. A hyperfrequency resonant system as claimed in claim 1, wherein said resonant element comprises a second resonant cavity fixed to said first resonant cavity and located on the path of said particle beam, said second resonant cavity being tuned at said harmonic frequency 2F and excited by means of said bunched particle beam at said harmonic frequency 2F.

3. A hyperfrequency resonant system as claimed in claim 1, wherein said resonant element is an integral part of said first resonant cavity which is cylindrically shaped and provided with radially positioned tuning pistons, at least one of said tuning pistons being located half-length of said first cylindrical resonant cavity which is simultaneously excited at said fundamental frequency F by means of said electromagnetic energy source and at said harmonic frequency 2F by means of said bunched particle beam.

4. A hyperfrequency resonant system as claimed in claim 1, said resonant system comprising a group of cavities similar to said first cavity and tuned at said fundamental frequency F, said cavities fixed to each other and disposed along the beam path being electromagnetically coupled to each other and excited by said external electromagnetic energy source at said frequency F, said resonant element being a complementary resonant cavity, mechanically fixed to one of the cavities of said group of cavities, said complementary resonant cavity being tuned at said harmonic frequency 2F and excited at said harmonic frequency 2F by means of said bunched particle beam.

5. A hyperfrequency resonant system as claimed in claim 1, wherein said resonant element is an integral part of said resonant system which comprises a group of cavities similar to said first resonant cavity, said cavities fixed to each other and disposed along said beam being cylindrically shaped and tuned at said fundamental frequency F, each of said cylindrical cavities of the group being provided with radially positioned tuning pistons, at least one of said tuning pistons of each of said cavities being located half-length of said cylindrical resonant cavity which can be simultaneously excited at said fundamental frequency F by means of said external electromagnetic energy source and at said harmonic frequency 2F by means of said bunched particle beam.

* * * * *